United States Patent [19]

Flores

[11] 3,997,166

[45] Dec. 14, 1976

[54] BOARD GAME APPARATUS

[76] Inventor: Geraldo Flores, 3261 Turlock Drive, Costa Mesa, Calif. 92626

[22] Filed: Aug. 4, 1975

[21] Appl. No.: 601,349

[52] U.S. Cl. ..... 273/134 C; 273/134 AT; 273/137 R

[51] Int. Cl.[2] ..... A63F 3/00

[58] Field of Search ..... 273/134

[56] References Cited

UNITED STATES PATENTS

| | | | |
|---|---|---|---|
| 3,556,528 | 1/1971 | Spiring | 273/134 AC |
| 3,674,273 | 7/1972 | Sells | 273/134 AA |
| 3,740,038 | 6/1973 | Feulner | 273/134 AD |
| 3,787,056 | 1/1974 | Hellmann | 273/134 C |

*Primary Examiner*—Delbert B. Lowe
*Attorney, Agent, or Firm*—Dominick Nardelli

[57] ABSTRACT

A game, of the travel type, is disclosed wherein a square playing board has a course going around the periphery thereof, and the course is divided into a plurality of segments. The number of segments on one side is equal to the number of segments along each of the other sides. One of the corner segments is the starting place for play, and the other 3 corner segments represent havens or obstacles for the traveler (player). Alternate segments on each respective side are marked with geographical destinations, with segments therebetween marked with indicia, which the rules of the game provide direct the picking of either a flight or a landing instruction card. The flight and landing instruction segments also alternate. The game includes additional apparatus, such as a plurality of playing pieces simulating aircraft, flight instruction cards, landing instruction cards, and four playing pieces, which the players move around the board on the course in response to a chance device. The center of the board has indicia thereon so that a player can keep track of the number of aircraft he has in flight. Each type of aircraft is assigned to a particular geographical destination.

4 Claims, 3 Drawing Figures

FIG. 1
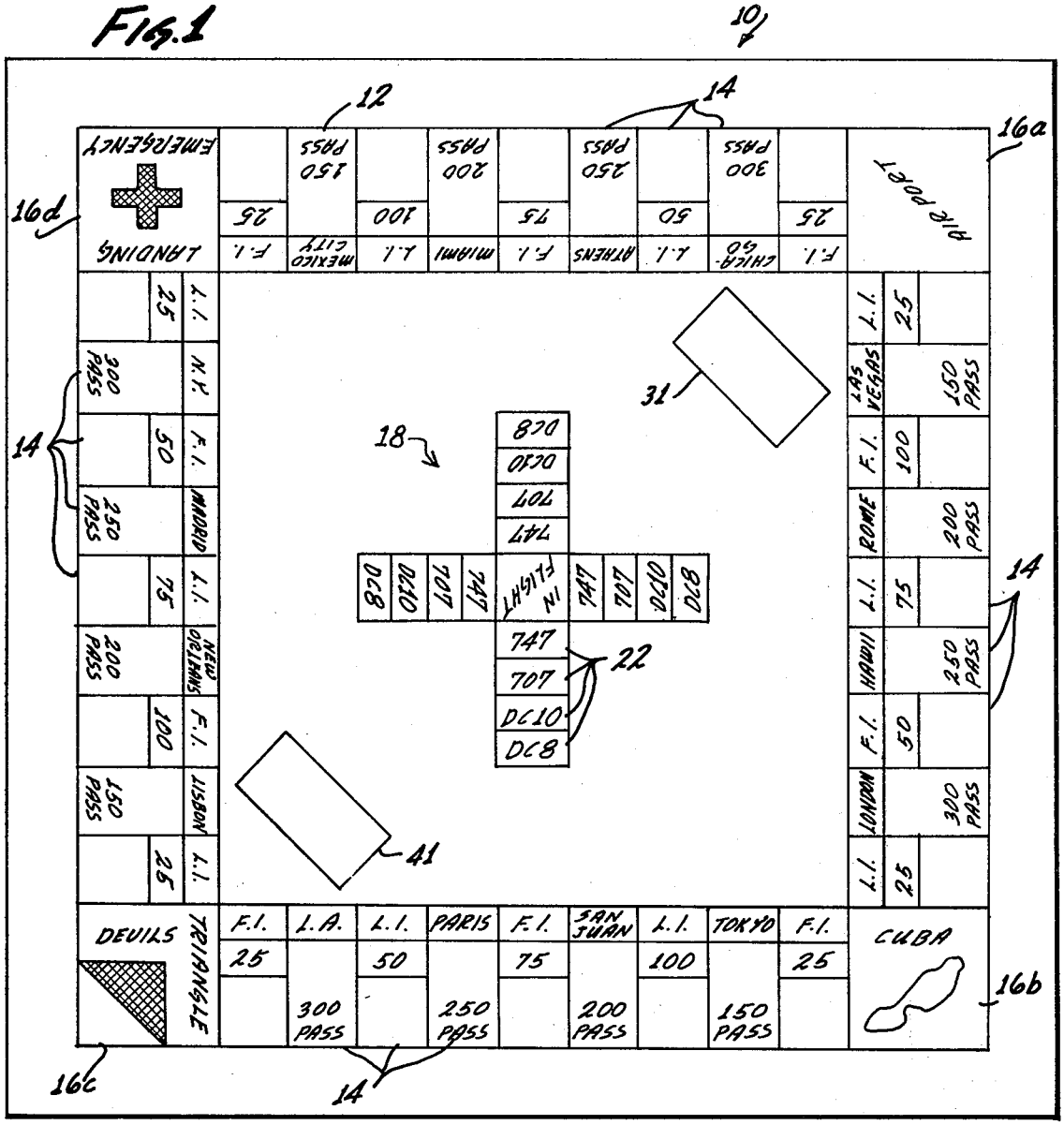
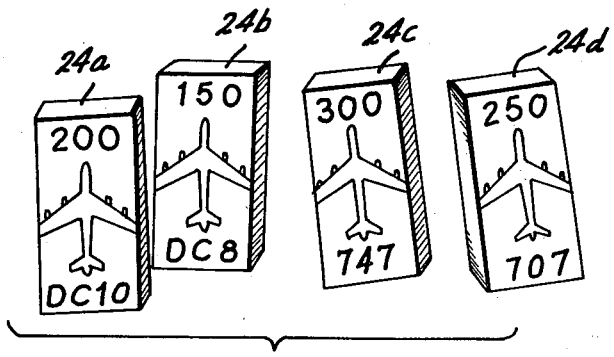
FIG. 2
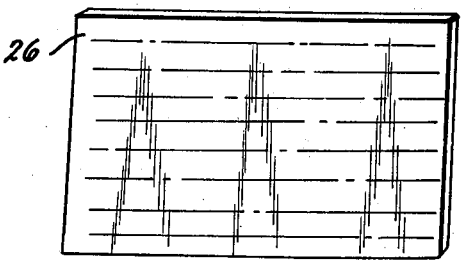
FIG. 3

BOARD GAME APPARATUS

FIELD OF THE INVENTION

This invention relates to a game apparatus, and more particularly to a travel game that simulates business planning for operating an airline for profit.

BACKGROUND OF THE INVENTION

Games which involve simulated business ventures have been subject to numerous patent applications over the years. For example, U.S. Pat. No. 748,626 describes a game called the "Landlord's Game" and U.S. Pat. No. 2,026,082 describes the popular "Monopoly" game. Other patents in the field include U.S. Pat. Nos. 2,976,044; 3,163,423; 3,198,521; and 3,807,739.

The prior art patents teach games wherein the primary investment is either real estate, stock certificates, or insurance. A disadvantage of these games is that very early in the game the winner could be decided, because when one player falls behind catching up is very difficult.

OBJECTS OF THE INVENTION

An object of this invention is to provide a game that simulates an airline operation.

Another object of this invention is to provide a game wherein the outcome cannot be determined relatively early in the game.

Another object of this invention is to provide a game wherein the players have multiple choices or decisions to make as they play the game, thereby preventing early monopolies.

These and other objects and features of advantage will become more apparent after studying the following description of the preferred embodiment of my invention, together with the appended drawings.

BRIEF DESCRIPTION OF THE DRAWINGS

FIG. 1 is a plan view of a playing board in accordance with the present invention.

FIG. 2 shows, pictorially, a plurality of playing pieces simulating aircraft.

FIG. 3 is a pictorial view of one of the instruction cards.

DETAILED DESCRIPTION OF THE INVENTION

Referring to FIG. 1, the game has a playing board 10, which is preferably square, for reasons that will become apparent hereinafter, and has printed thereon a course 12 going around the board, as shown. This course 12 is made up of a plurality of segments 14, each of which has written therein indicia representing information or instruction. At each corner is marked a corner segment, 16*a*, 16*b*, 16*c*, and 16*d*, respectively. For clarity, the segments 14 along one side each have the same color, which is different than the color of the segments on the other three sides. The corner segment 16*a* is where each player starts and moves a pawn (not shown) in a clockwise direction. Since the game simulates the business operation of multiple airlines, this square 16*a* is marked "airport." The next segment 14 in a clockwise direction contains the indicia "LI" and a two digit number 25 wherein the capital L and capital I stand for "landing instructions", and the numeral 25 stands for an amount of money in hundreds of dollars, or a number of passengers. The next following segment 14, in a clockwise direction, is marked with a designation or destination "Las Vegas." Also in the designation segment there is a three digit number, which represents a number of passengers for reasons that will become apparent hereinafter. The next following segment 14 is marked with an indicia "FI" with a three digit number 100, wherein the capital F and capital I stand for "flight instruction", and the numeral 100 stands for an amount of money, in hundreds of dollars, or a number of passengers. The next following segment 14 is similarly marked except for the designation and the three digit number. The next following segments 14 would be substantially as shown in FIG. 1. Corner segment 16*b* represents a hazard, such as "highjacking"; corner segment 16*c* represents another hazard, such as "foul weather"; and corner segment 16*d* represents a haven (emergency landing field), wherein to land a damaged jet airliner. In the center of the board are formed markings in the shape of a cross 18 containing indicia such as "IN FLIGHT" and various characters, and the cross 18 is used to keep track of which aircraft of the respective players are flying. Each leg of the cross 18 has four segments 22 which are marked with the identification of the different jet liners which are used for play. These different jet liners 24 are shown enlarged in FIG. 2, and are preferably a rectangular solid of the size of 1-¼" by ½" by ⅛". The game would have four sets of jet liners, one of which sets is shown in FIG. 2. The numbers at the noses of liners 24 represent the number of passengers each aircraft would carry, and the designation segments 22 on one respective leg of the cross 18 have the indicia to correspond to the several jet liners in play. Each leg of cross 18 is similarly marked.

FIG. 3 shows a typical card 26. In playing the game, many cards 26 are provided. Some of the cards are maked on one side with the indicia "Flight Instruction" and the others are marked with the indicia "Landing Instruction." The opposite sides of each group have information printed thereon. For example, the FI group (flight instruction) would have several cards marked with the following information, as an example, "Airport Fogged In — All Flights Canceled — Wait for Further Flight Instructions." Or, "Flight Delayed — Oil Slick on Runway — Wait for Further Flight Instructions"; "Noise Abatement — Your Flight has been Canceled — A Judgment has been Awarded to Homeowners Below Flight Pattern — Pay $25,000 and Wait for Further Instructions"; "Negotiations Between Airlines and Ground Crew Unions Have Faltered — Your Ship May Not Go Into Flight — Await Further Instructions"; "Clear for Takeoff"; "Electronic Malfunction — Ship Has Failed Final Inspection Before Takeoff — Delay in Labor Costs for Corrections — Pay $10,000 and Wait For Further Flight Instructions"; and "Direct Flight — Your Ship has been Cleared for Takeoff and Landing — Go Direct to Your Destination"; and "Clear for Takeoff." The LI group (landing instruction) would have several cards marked with the following information, as an example: "Control Tower Has Lost Radar Contact Over Devil's Triangle; Crew, Ship and Passengers Lost"; "Your Pilot Has Suffered a Severe Stroke — Co-pilot has set the Ship on Auto Pilot — Remain in Flight until you Receive Further Landing Instructions."; "Pilot to Tower — Highjacking on Board — Going to Cuba — A fine of $25,000 must be satisfied before Ship is Released — Wait for Further Flight Instructions."; "Clear for Landing"; "Pilot to Tower, Landing Gear has Malfunctioned — Proceed to Emergency Landing — Pay $20,000 Landing Damages to Ship and Wait for Further Flight Instructions"; "Air Traffic Congested — Remain in Flight"; "Pilot Error — Lost Crew, Ship and Passengers on Mountain Peak."; "Pilot to Tower, Number One Engine on Fire — Proceeding to Emergency Landing — Damage to Ship — Pay $15,000; Passenger Accommodations — Pay $10,000 — Wait for Further Flight Instructions."; "Pilot to Tower — Bomb on Board — Proceed to Emergency Landing — Bomb Squad and Passenger Accommodations, pay $15,000 — Wait for Further Instructions"; and "Inclement Weather — Your Ship has been ordered to Land at alternate airport Chicago — Pay $15,000 passenger accommodation, and wait for further landing instructions." In addition, chance means and up to four different colored pawns or playing pieces, all of which are not shown, are included in the game.

Basically the game is played as follows: Between two or four persons can play the described game, and each person chooses a colored pawn and the corresponding colored segments 14. The pawns are placed in the segment 16*a*, marked "airport," and each player rolls the dice and moves his pawn clockwise the corresponding number of segments 14 and 16. If he lands on a LI or a FI segment 14, he has one choice, and that is to collect cash from the treasurer, which cash is related in hundreds to the numerals in the segments. If the player lands on a designation segment 14, he waits for his next turn. Each player plays in turn. The first object for each player is to accumulate sufficient cash to purchase one of the aircraft 24*a*, 24*b*, 24*c* or 24*d*. He has a choice of which airplane to purchase. Each airliner is priced in accordance with its size; the larger airplane, which holds more passengers, costs more. After a player purchases an airplane and after he stops on an LI or a FI segment, he has a choice to obtain more money from the treasurer, or to collect passengers. The number of passengers to which he is entitled is the number in the segment in which he stops. As mentioned above, cash is recorded by the use of play money, and the number of passengers is recorded by passenger cards, with numerals 25, 50, 75, and 100 marked thereon (not shown). After a player has purchased an airplane and has accumulated the required number of passengers for that airplane, he must wait until he lands on an FI segment 14 before he can take off and be in the "IN FLIGHT" markings 18. When he stops on an FI segment 14, he has the choice to pickup a flight instruction card 26, which cards are stacked face down on a rectangle 31 on the board 10. Depending on what card is on top of the stack, that card gives him his instructions. If the card says "Clear for Takeoff," he places his airplane in a corresponding segment 22 of the "IN FLIGHT" marking 18, i.e., the segment 22 closest to his side. If he happens to pick the card marked with "direct flight," he places his airplane on the designation segment 14, so that the passenger number on the aircraft matches the passenger number in his segment 14.

While the player has an airplane in "IN FLIGHT" marking 18, and he stops on an LI segment 14, he must choose one of the landing instruction cards 26 that have been placed face down on rectangle 41. He follows the intructions on the card. If, however, the card picked is marked to report to emergency landing, before he can clear his airplane for flight again he must wait until he stops in an LI segment and then he is able to pick a card and, if it says "cleared for takeoff," he can be in flight again. The player that first lands all four aircraft at their respective designations is the winner.

Briefly, the winner is not determined by the speed at which a particular pawn traverses the course to reach its destination. The function of the pawn is to give instructions to the players. All players start in one corner, but each player picks one side of the square as his domain, i.e., where his aircraft is to land. The purpose of assigning each player to a side is so that one can readily remember his destination. You will note that each side has four destinations, and each destination on one side has different passenger numerals. However, the numerals on each side add up to the same sum. Each player starts his pawn at the same corner. In order for a particular player to receive money, passengers, etc., he does not need to wait for his pawn to reach an "FI" or an "LI" segment on his side of the square. He receives them whenever his pawn lands on any FI or LI segment. Thus, all the players can collect $10,000 if the dice tells them to stop on the first FI segment, going clockwise from "airport." The winning player is the first one to buy four different aircraft out of the supply and land them at their four separate destinations. The sides are colored for aesthetic purposes and also to aid the memory of the players. One can see that one player could traverse the course several times more than another player and win the game. Then again, one can see that one player can traverse the course many times more than another player and still lose the game. The trick is believed to be to land the pawns on a high numeral segment so that you can rapidly purchase aircraft, collect passengers, and take off to your destination.

Other variations of the rules of play can be made without departing from the spirit of my invention. One skilled in the art can devise other embodiments without departing from the spirit of my invention. Therefore my invention is not to be limited to the described embodiments, but includes all embodiments falling within the scope of the appended claims.

I claim:

1. An apparatus for playing a game comprising:

a playing board having:

a continuous course extending about the surface of said board;

first means dividing said course into a plurality of segments;

said segments being divided into at least a first group of segments and a second group of segments;

each of said groups of segments being divided into at least a first sub-group of destination segments (items 14 geographically named) and a second sub-group of FI and LI segments (items 14 marked with indicia LI and FI);

said destination segments of each one of said respective first sub-groups alternating with said FI and LI segments of each one of said respective second sub-groups of segments;

each of said destination segments of one of said first sub-groups of segments being marked to represent different geographical destinations;

each of said FI and LI segments of one of said second sub-groups of segments being marked with numerals, and some of said FI and LI segments of said second sub-group being marked FI segments and the remaining of said segments of said same sub-group being marked LI segments with the FI segments alternating with said LI segments;

a supply of simulated aircraft;

said playing board also having markings disposed surrounded by said course;

said markings outlining more than one region on said board so that one of said aircraft can be placed on one of said regions to indicate that said aircraft is in flight to one of said geographical destinations represented by one of said destination segments;

playing pawns for traversing said course;

chance means operable by players of said apparatus for determining the number of segments to be traversed by a playing pawn;

a supply of simulated money;

a stack of FI cards bearing flight instructions on one side thereof so that a player, when his pawn lands on an FI segment, may pick said top FI card, so that his aircraft may be placed in one region of said markings;

a stack of LI cards bearing landing instructions on one side thereof so that when a player's pawn lands on an LI segment, he may pick said top LI card so that his aircraft may leave said one region to be moved to one of said destination segments of one of said first sub-groups.

2. The apparatus of claim 1 wherein:

each of said segments in one sub-group contains numerals and each numeral is different in the same sub-group.

3. The apparatus of claim 2 wherein:

the number of destination segments in one of said first sub-groups of segments is equal to the number of destination segments in the other of said first sub-groups of segments;

the number of FI segments in one of said second sub-groups is equal to the number of FI segments in the other of said second sub-groups;

the number of LI segments in one of said second sub-groups is equal to the number of LI segments in the other of said second sub-groups.

4. The apparatus of claim 3 wherein:

the numerals in each FI and LI segments of one of said second sub-groups correspond to the numerals in the FI and LI segments in the other of said second sub-groups.

* * * * *